US005617984A

United States Patent [19]

Fabel

[11] Patent Number: 5,617,984

[45] Date of Patent: Apr. 8, 1997

[54] BACKPACK SUSPENSION SYSTEM

[76] Inventor: John A. Fabel, 120 Pulpit Hill Rd. #14, Amherst, Mass. 01002

[21] Appl. No.: 390,665

[22] Filed: Feb. 17, 1995

Related U.S. Application Data

[63] Continuation-in-part of Ser. No. 307,277, Sep. 16, 1994.

[51] Int. Cl.[6] ..... A45F 3/14

[52] U.S. Cl. ..... 224/641; 224/660

[58] Field of Search ..... 224/224, 211, 224/215, 216, 262, 637, 641, 660, 662

[56] References Cited

U.S. PATENT DOCUMENTS 4,332,379 6/1982 Bannister ..... 224/215 X
5,025,965 6/1991 Smith ..... 224/224 X
5,090,604 2/1992 Howe ..... 224/211
5,228,609 7/1993 Gregory ..... 224/224

*Primary Examiner*—Renee S. Luebke
*Attorney, Agent, or Firm*—Brian M. Dingman

[57] ABSTRACT

A system for backpacks that allows the backpack to be worn comfortably without shoulder straps. This is accomplished with a pair of generally triangular shaped flaps that are attached to the pack at symmetrical locations, typically the front or rear corners. The free edges of the flaps approximate catenary curves. Adjustable-length straps connect the apex of each flap to the backpack waistbelt. The flaps distribute tension relatively evenly along a substantial portion of the height of the packbag or frame, which pulls the packbag more tightly against the wearer's back, so that it can be worn comfortably without shoulder straps. The system may also be used with shoulder straps in order to lessen the stress on the user's shoulders.

19 Claims, 3 Drawing Sheets

BACKPACK SUSPENSION SYSTEM

CROSS REFERENCE TO RELATED APPLICATION

This application is a continuation in part of copending application Ser. No. 08/307,277, filed Sep. 16, 1994.

FIELD OF INVENTION

This invention relates to a backpack suspension system that allows the option of a backpack to be comfortably worn without the need for shoulder straps.

BACKGROUND OF INVENTION

Backpacks typically include a packbag which is designed to carry items of interest to the wearer. The packbag is sometimes carried on a rigid frame. Most backpacks have a waist belt attached to the bottom portion of the packbag that is made to encircle the wearer's torso and is adjustable for a snug fit. Some of the weight of the pack is carried by the shoulder straps, which are also adjustable so that the packbag can be snugged against the wearer's back and hips as desired.

Because these backpacks rely on the shoulder straps to carry some of the load, the packs exert a substantial backwards pull at the shoulders of the wearer, causing back fatigue and strain. Further, the shoulder straps hinder arm and shoulder movement, which limits the enjoyability of wearing the backpack.

SUMMARY OF INVENTION

It is therefore an object of this invention to provide a backpack suspension system which allows the option of the pack to be worn without shoulder straps.

It is a further object of this invention to provide such a backpack suspension system which reduces or eliminates back fatigue and strain.

It is a further object of this invention to provide such a backpack suspension system which results in greater freedom of arm and shoulder movement for the user.

It is a further object of this invention to provide such a backpack suspension system which has fewer straps and is easier to use.

This invention results from the realization that shoulder straps can be eliminated from a backpack, thereby reducing back fatigue and freeing the arms and shoulders for greater movement, by providing an adjustable-length tension element which runs upward from the waistbelt and is connected to the backpack along a substantial portion of the height of the packbag to distribute the tension between the waistbelt and the packbag over a broad area of the pack.

BRIEF DESCRIPTION OF THE DRAWINGS

Other objects, features and advantages will occur to those skilled in the art from the following description of preferred embodiments, and the accompanying drawings, in which.

DESCRIPTION OF THE PREFERRED EMBODIMENTS

This invention features a backpack suspension system which is adapted to hold the backpack packbag (or the frame to which the packbag is attached) against the wearer's back and hips, to eliminate or lessen the need for shoulder straps. This eliminates the downward pull on the user's shoulder's created by shoulder straps, which permits greater freedom of movement of the user. This also facilitates greater transfer of the load from the wearer's shoulders to the lower torso and hips, and pulls the packbag in and stabilizes it against the wearer's back.

These aims are accomplished by including a pair of adjustable-length load transfer members that run between the backpack waistbelt and the packbag, or the frame carrying the packbag. The members are attached to the waistbelt preferably at a point from several inches behind to several inches forward of the wearer's hip crest. The other end of the adjustable-length load transfer members are fixed to the packbag or the frame carrying the packbag, along a substantial portion of the height of the packbag or frame, as appropriate. The lines of attachment of the load transfer members to the packbag or frame are preferably vertical and preferably fall along the front or rear corners of the packbag or frame, as appropriate. These members serve to distribute the tension between the waistbelt and the packbag or frame over a broad area of the packbag or frame to pull in and stabilize the pack against the wearer's back.

The load transfer members of the backpack suspension system of this invention can take a variety of forms. In the most preferred embodiment, these members take the approximate form of an asymmetrical isosceles triangle, with the longest edge attached to the packbag or frame. An adjustable-length strap is then connected between the apex of each flap and the waistbelt. The angle of the strap follows approximately the contour of the longest free edge of the flap. In this embodiment, the free edges of the flaps preferably describe concave curves, which may approximate a catenary to more effectively transfer the load along the entire length of the flap edge attached to the packbag or frame.

Figure 1A:
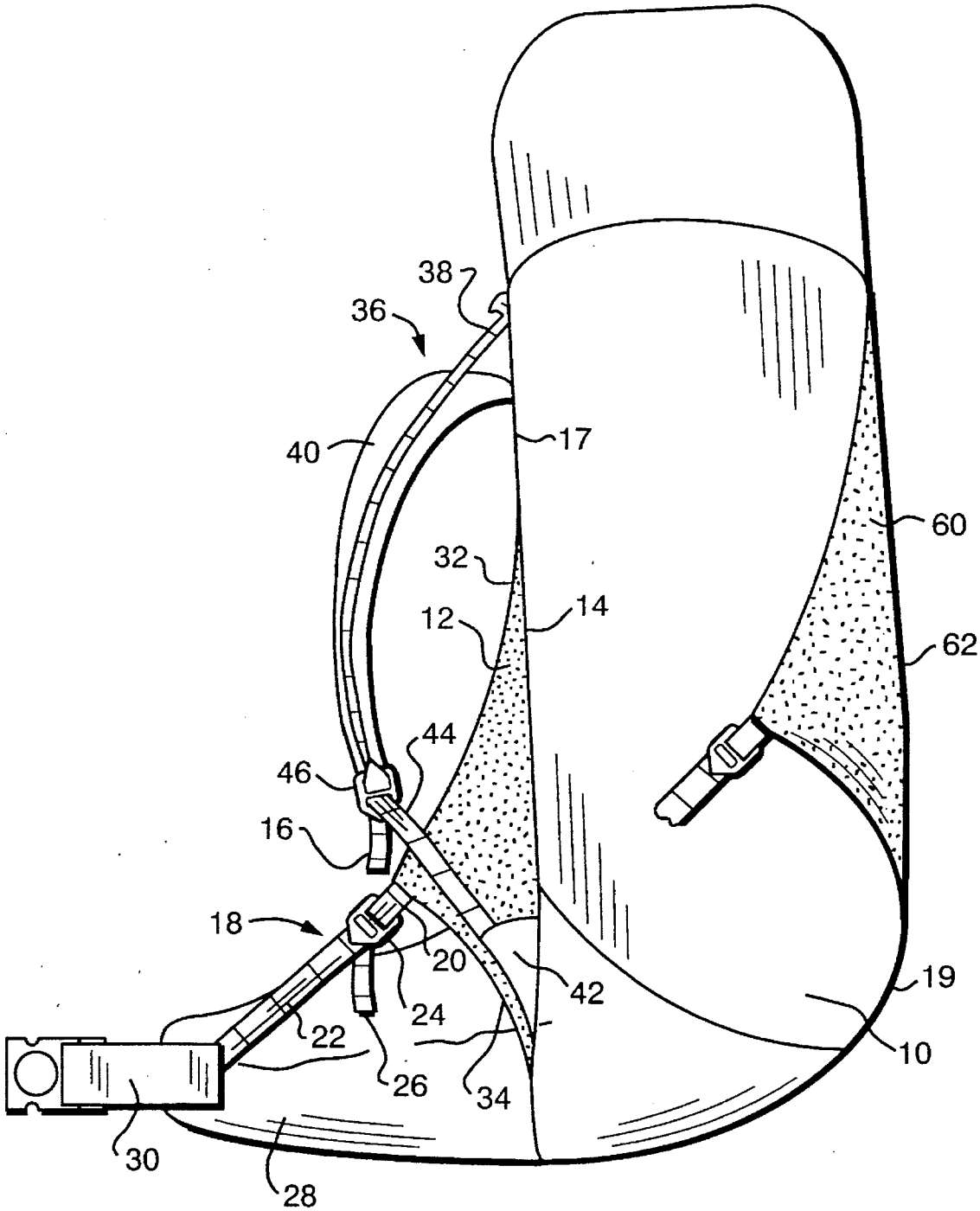
FIG. 1A is a side elevational view of a backpack with the backpack suspension system of this invention, disclosing two preferred locations for the load transfer flaps of the invention.

There is shown in FIG. 1A two embodiments of the backpack suspension system of this invention. The suspension system is adapted to firmly hold backpack packbag 10 against the wearer's back and hips. If the backpack has a frame, then the frame is held against the back and hips.

The backpack includes a waistbelt which is adapted to encircle the wearer's torso, and is adjustable in length so that it can be properly fitted to a variety of wearers. In the side view of FIG. 1, one half of the waistbelt is depicted as belt-portion 28 which is sewn at one end to packbag 10 and at the other end has a length-adjustment buckle member 30. This waistbelt style is known in the art.

Also shown in this drawing is shoulder strap 36 which includes web member 38 with padding 40, and second web member 44 attached to the lower portion of packbag 10 through attachment flap 42. The other end of web 44 is passed through buckle 46 that provides for length adjustment of shoulder strap 36. The need for shoulder straps such as strap 36 is decreased or totally eliminated by the backpack suspension system of this invention. This backpack suspension system includes a pair of adjustable-length load transfer members, each of which is fixed at one end to the waistbelt, and fixed at the other end to a substantial portion of the height of the packbag. In the embodiment shown in FIGS. 1A and 1B, this member is accomplished with a pair of generally polygonal load transfer flaps 12 and 13, FIG. 1B. The flaps are attached along a substantial portion of the height of the packbag. "Substantial portion" is defined as at least 40% of the height of the packbag or frame. Closer to 70% is preferable to accomplish the aims of this invention. Any more than 70% is superfluous. As best shown in FIG. 1A, load transfer flap 12 has the general form of an asymmetrical isosceles triangle with the longest edge 14 sewn to a front corner 17 of packbag 10. An alternate location for the load transfer flap is depicted by flap 60 which is sewn along its longest edge 62 to the back corner 19 of packbag 10.

The length adjustment in this embodiment is accomplished by providing a pair of adjustable-length members, which in this case take the form of adjustable length straps such as strap 18, FIG. 1A. Strap 18 includes strap member 20 which is fixed at one end proximate the apex 16 of flap 12, and at the other end to buckle member 24. Second strap member 22 is fixed at one end to waistbelt 28. The other end 26 of strap member 22 is threaded through buckle 24 to provide the length adjustment for strap 18. The arrangement is preferably such that the length adjustment is accomplished by the user pulling forward and away from his or her body, as would be accomplished by having two adjustable-length straps as shown, only one of which is shown in FIG. 1A.

Figure 1B:
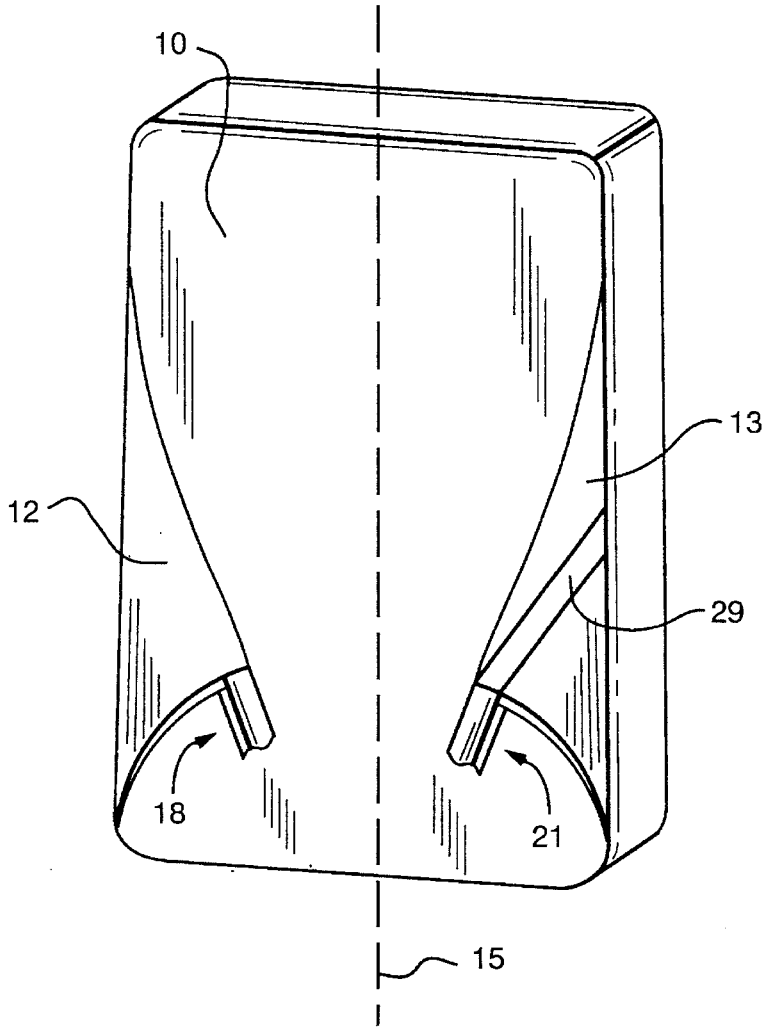
FIG. 1B is a partial front view of the backpack and backpack suspension system of FIG. 1A, showing one preferred location of attachment of the load transfer flaps of FIG. 1A.

Both straps 18 and 21 are depicted, partially, in FIG. 1B. This figure also serves to illustrate that the load transfer members 12 and 13 are attached to packbag 10 at symmetrical locations with respect to a central axis 15 of packbag 10. The lines of attachment may be anywhere on the packbag, but are preferably outside of the area of the bag which would typically touch the wearer's back in use. The best locations have been determined to be either the front or rear comers of the packbag. Stiffening members 29 (only one shown) can be added, as explained below, to help transfer load across flap 13.

Figure 2:
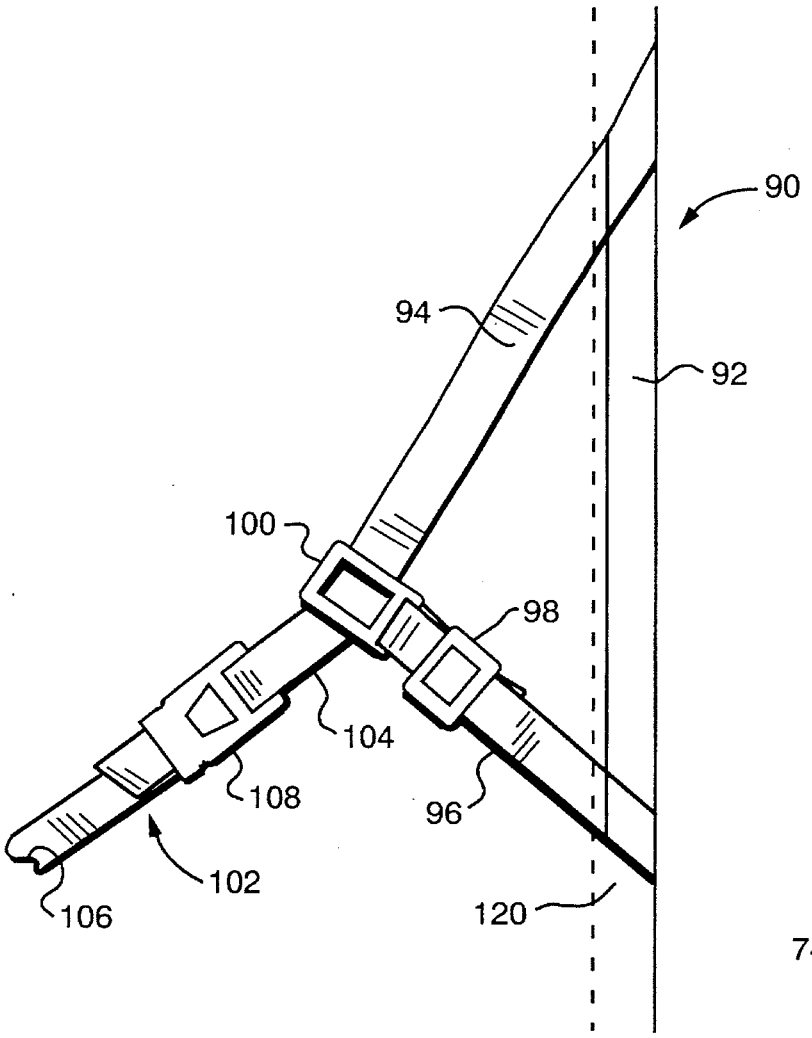
FIG. 2 is a side view of an alternative construction of the load transfer flaps of the backpack suspension system of this invention.
Figure 3:
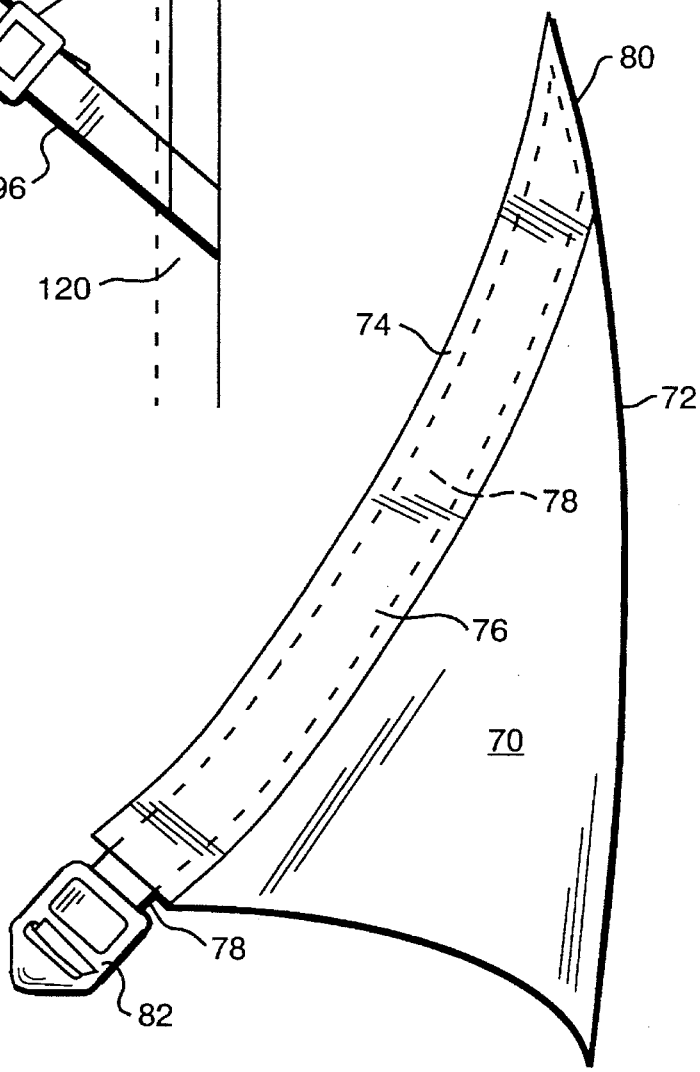
FIG. 3 is a side view of a second alternative construction of the load transfer flaps of the backpack suspension system of this invention.

Two alternative constructions of the load transfer members of this invention are depicted in FIGS. 2 and 3. FIG. 2 discloses a second embodiment of a generally polygonal load transfer flap 90 according to this invention. In this case, flap 90 comprises webbing 94 and adjustable-length webbing 96 (length adjustment provided using buckle 98 as is known in the art) which are both connected to three-way connecting buckle 100. The other ends of straps 94 and 96 are connected to rigid member 92 which is placed within pack 120. This rigid member may also be represented by an internal or external frame member. In this case, length adjustment is also provided by an adjustable-length two part strap 102 which includes upper strap member 104 and lower strap member 106 which both engage buckle 108, similar to the construction described above in conjunction with FIG. 1A.

Yet another alternative construction of the flap is depicted in FIG. 3. In this case, flap 70 is similar in shape to flap 12, FIG. 1A. Flap 70 has incorporated along its longest free edge 74 a sleeve 76 which is typically accomplished by folding the material of the flap over and sewing the edge back to the body of flap 70. Flexible cord or webbing 78 is fastened within sleeve 76 at or near the point of attachment of edge 72 to the packbag, not shown. This point is depicted generally at 80. Cord or webbing 78 runs freely through sleeve 76 and ends at buckle 82, which has threaded through it the second, lower strap member which provides the length adjustment as described above (not shown in this drawing for clarity purposes). Flexible cord or webbing 78 serves to transfer the load more uniformly along the length of edge 74, thus transferring the load more uniformly along the length of edge 72 sewn to the packbag, for more even load distribution. A similar sleeve with webbing running therein may also be positioned along the lower free edge of flap 70, with the webbing running to buckle 82.

Figure 4:
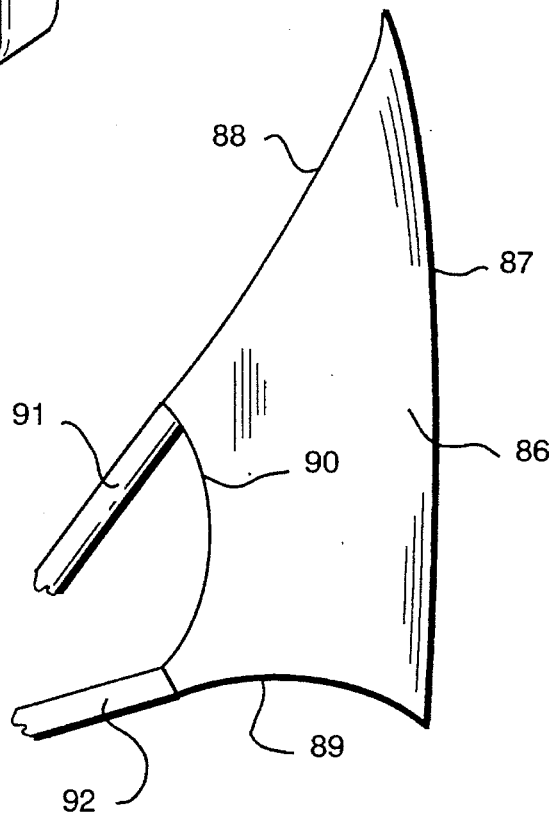
FIG. 4 is a side view of another alternative construction of a load transfer flap of this invention, depicting a non-triangular flap shape.

FIG. 4 depicts another alternative shape for polygonal load transfer flap 86 according to this invention. A generally triangular shape is preferred in embodiments in which there is only one strap fixed between the flap and the waistbelt. In this embodiment, however, straps 91 and 92 are both fixed to the waistbelt. This requires an alternative construction such as that shown in FIG. 4 to apply the load as evenly as possible along the length of flap edge 87 which is sewn to the packbag, not shown. The exact shape may be determined empirically by applying load to the straps and determining whether free edges 88, 89 and 90 are under tension or not. Ideally, tension should be evenly applied along the lengths of edges 88 and 89 so that tension is applied along the length of edge 87. Edges 88 and 89 will typically be concave curves which define, approximately, catenaries.

When polygonal load transfer flaps are employed, the free edges of the flap are preferably contoured to describe a concave curve similar in shape to a catenary. The exact shape is best determined empirically based on the location and angle of the adjustable length strap(s) attached proximate the apex(es) of the load transfer flaps. The correct edge shape has been obtained when the flap edges exhibit tension when under load from the adjustable-length straps.

The flaps are made primarily but not exclusively from woven or knit materials. Flaps may be made entirely of non-woven materials. When made from woven materials, the weave of the fabric should generally be aligned with the primary vector of tension load applied. The free edges of the flap may be stabilized through means such as top stitching along the edge of the fabric, the sewn application of a fabric tape to the fabric edges, or any other means to minimize distortion of the flap edges under load. The flaps may also contain stiffening elements which serve to further mechanically transfer weight from the packbag to the waist or hip encircling belt. Such elements may take the shape of thin elongated stiff members which are sewn into the flap, for example by providing pockets on the flap into which the stiffening members are slipped, and then the pockets are closed.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A backpack suspension system adapted to firmly hold a packbag or frame of a backpack against the wearer's back and hips, the backpack including a waistbelt for encircling the wearer's torso, the suspension system comprising:

a pair of load transfer means each defining a generally polygonal shape with a plurality of edges, and each defining a longest edge, said load transfer means each attached along their longest edge along a substantial portion of the height of the packbag or frame and at symmetrical locations of the packbag or frame, respectively, leaving free edges not attached to the packbag or frame, in which said load transfer means are each spaced from the waistbelt; and a pair of adjustable-length members, each attached to a said load transfer means and to the waistbelt, for allowing adjustment of the spacing between each said load transfer means and the waistbelt;

wherein at least one free edge of each said load transfer means describes a concave curve approximating a catenary, so that said load transfer means distribute tension from said waistbelt along a substantial portion of the height of the packbag or frame to hold the packbag or frame, along its height, more firmly against the wearer's back and hips.

2. The backpack suspension system of claim 1 in which each said load transfer means is a load transfer flap.

3. The backpack suspension system of claim 2 in which each said load transfer flap is a generally triangular-shaped flap.

4. The backpack suspension system of claim 3 in which at least two said free edges of each said load transfer flap describe concave curves.

5. The backpack suspension system of claim 4 in which said concave curves each approximate a catenary.

6. The backpack suspension system of claim 1 in which each said adjustable-length member includes an adjustable-length strap, with one end attached to said load transfer means and the other end attached to the waistbelt.

7. The backpack suspension system of claim 6 in which the length adjustment for each said strap is accomplished with a buckle member along the length of said strap, wherein each said strap includes two separate strap members, each with one end connected to said buckle member.

8. The backpack suspension system of claim 1 in which each said load transfer means is attached along a front corner of the packbag or frame.

9. The backpack suspension system of claim 1 in which each said load transfer means is attached along a rear corner of the packbag or frame.

10. The backpack suspension system of claim 1 in which each said load transfer means has a first free edge running down from the packbag or frame to a load transfer means apex at which said adjustable-length member is attached to said load transfer means.

11. The backpack suspension system of claim 10 in which said adjustable length members are adjustable-length straps, wherein one end of each said strap is attached to a said load transfer means at the apex thereof, and the other end of each said strap is attached to the waistbelt; in which each said strap lies along a line which is at an angle to said first free edge that approximately follows said concave curve approximating a catenary.

12. The backpack suspension system of claim 10 further including mechanical structure along said first free edge of each said load transfer means for distributing tension load along the height of each said bond transfer means.

13. The backpack suspension system of claim 12 in which said mechanical structure includes a load transfer member running through a sleeve formed along said first free edge.

14. The backpack suspension system of claim 13 in which said load transfer member includes a flexible member attached at one end to said adjustable length member and at the other end to the packbag or frame.

15. The backpack suspension system of claim 1 in which each said load transfer means, comprises a pair of strap members attached to the packbag or frame at vertically-spaced locations, and attached together and to a said adjustable-length member.

16. The backpack suspension system of claim 15 in which each said load transfer means further includes a rigid member within or attached to the packbag and running between the points of attachment to the packbag or frame of the strap members.

17. The backpack suspension system of claim 15 in which at least one said strap member is an adjustable length member.

18. The backpack suspension system of claim 15 in which at least one strap member of each said pair of strap members is an adjustable-length strap member.

19. A backpack suspension system adapted to firmly hold a packbag of a backpack against the wearer's back and hips, the backpack including a waistbelt for encircling the wearer's torso, the suspension system comprising:

a pair of generally triangular load transfer flaps, each with a longest edge, said longest edges of said flaps attached along generally vertical lines at symmetrical locations of the packbag, leaving two free edges on each said flap;

a pair of adjustable-length straps, each attached proximate one end to a said load transfer flap proximate the apex of said free edges of said flap, and proximate the other end to the waistbelt at an area forward of the apex of said flap, said straps each including a buckle member between the ends providing the length adjustment; and wherein at least one free edge of each said flap approximates a catenary curve to more evenly distribute tension from said straps through said flaps along a substantial portion of the height of the packbag to hold the packbag, along its height, more firmly against the wearer's back and hips.

* * * * *